United States Patent [19]

Eberle

[11] Patent Number: 4,479,342

[45] Date of Patent: Oct. 30, 1984

[54] POST FRAME BUILDING AND METHOD OF CONSTRUCTING THE SAME

[76] Inventor: George F. Eberle, 414 Killearn La., St. Louis, Mo. 63141

[21] Appl. No.: 427,686

[22] Filed: Sep. 29, 1982

[51] Int. Cl.[3] ..... E04B 1/00

[52] U.S. Cl. ..... 52/742; 33/180 R; 52/90; 52/741

[58] Field of Search ..... 52/741, 743, 750, 748, 52/105, 90; 33/404, 406, 412, 414, 180 R

[56] References Cited

U.S. PATENT DOCUMENTS

| | | | |
|---|---|---|---|
| 3,159,394 | 12/1964 | Burns | 33/180 R |
| 3,169,320 | 2/1965 | Currie | 33/180 R |
| 3,662,502 | 5/1972 | Wright | 52/741 |
| 3,991,532 | 11/1976 | Buxbom | 52/743 |
| 4,202,108 | 5/1980 | Adams, Jr. et al. | 33/414 |
| 4,413,460 | 11/1983 | Gerlach | 52/741 |

*Primary Examiner*—John E. Murtagh
*Assistant Examiner*—Andrew J. Rudy
*Attorney, Agent, or Firm*—Gravely, Lieder & Woodruff

[57] ABSTRACT

A post frame building utilizes wood posts or columns composed of upper and lower sections that are initially detached. The lower sections are set into the ground in the usual manner, and as a consequence, the top of each lower section is at a slightly different elevation. Each lower section bears a reference mark, which for all sections is located the same distance below the upper ends of those sections, and in addition after it is set into the ground, is provided with another reference mark. As to all lower sections these other reference marks are at the same elevation. The upper sections are precisely the same length, and each has a pocket opening out of its upper end. The upper sections are installed on their respective lower sections to complete the columns, but only after leveling blocks are placed in the pockets of the upper sections. The leveling blocks are all initially the same length, that length being less than the depth of the pockets. Before being installed in their respective pockets, the leveling blocks are cut off to compensate for the variations in elevation among the lower column sections, and the amount that is cut from each block is determined by measuring the distance between the two reference marks on the lower section above which the block will be positioned. When the upper sections are installed on their respective lower sections with the leveling blocks in place, the upper surfaces of the leveling blocks for all the sections are at the same elevation. The ends of roof trusses are then lowered into the pockets at the upper ends of the columns and allowed to rest on the leveling blocks.

10 Claims, 8 Drawing Figures

50
40
6
48
38
4
46
44
42
2
8
36
10
10
34
32
x
28
34
32
31
10
24
22
16
30
26
21
b
29
30
c
20
14
18

28
31
24
22
16
26
30
21
30
30
b
c
x
20
14
18

POST FRAME BUILDING AND METHOD OF CONSTRUCTING THE SAME

BACKGROUND OF THE INVENTION

This invention relates in general to post frame buildings and more particularly to a method of constructing such buildings and to an improved building resulting therefrom.

Post frame buildings, which evolved from the so-called pole barns, are used for a wide variety of commercial, industrial and agricultural purposes, for they are, compared to other types of construction, relatively easy and inexpensive to erect. In this regard, the typical post frame building has a series of wooden posts or columns along its perimeter, with these columns being set into the earth. The columns are tied together by horizontal members, called girts, and support wooden roof trusses which are joined together with purlins. Bracing is also normally incorporated into the structure. The trusses in turn support a light weight roofing, whereas the girts have a suitable siding material attached to them.

The typical construction sequence involves boring a series of 12 inch diameter holes around the perimeter for the building on four to ten foot centers. Each hole is about four feet deep and a precast concrete base or a dry mix is placed at its bottom. Next, the posts or columns are set into the holes which are then back filled to maintain the poles in a truly vertical position. Since many buildings require clearances as high as 18 to 20 feet, it is not uncommon to use solid wood columns as long as 24 feet. These columns, because they are set into the earth, must be treated with a wood preservative. While it is possible to cut the columns to the same length, it is virtually impossible to control the depth of the holes with any precision, particularly when there are slight variations in grade. As a consequence, a chalk line is usually struck along the upper ends of the columns to establish the elevation for the bearing surfaces on which the roof trusses will rest. Once this elevation is established, a workman either cuts a notch (FIG. 2) into the upper end of the column with a chain saw or else nails a bearing block (FIG. 3) to the side of the column to provide the bearing surface. In either case, the workman must manipulate tools high in the air without any nearby support to provide stability, other than the column itself. Often the result is a poorly configured or inaccurately positioned bearing surface. Thereafter, the roof trusses are installed and likewise the girts and purlins. Then, before the roofing is installed, the columns are cut off flush with the upper chords of trusses, but this is considerably easier than notching the columns or attaching bearing blocks to them, because the trusses and the connecting purlins provide locations where the workman can gain a foot hold or hand hold or otherwise brace himself.

In a somewhat different procedure the columns are of a laminated nature, usually consisting of three or more 2×6's or 2×8's arranged side-by-side. Moreover, the column is usually supplied in two sections—a lower section which is treated with a preservative and an upper section which is not—and at the joint between the sections the center piece of each section is offset vertically from the two side pieces so as to create a slip joint. This type of arrangement must likewise be leveled so that all columns possess the same height, and this leveling is accomplished by cutting the three pieces of each lower section so that the upper ends of corresponding pieces for all of the lower sections are at the same elevation. While the workman can make these cuts while standing at grade elevation, still three cuts must be made with a good deal of precision. Then the upper sections are fitted over the lower sections and the two sections are joined together with nails or truss plates at the slip joint that is so formed.

While columns of this nature are not quite as strong as solid wood columns, they are perhaps somewhat easier to construct and they need not be treated with preservative throughout. Even so, three cuts must be made with considerable precision on a vertical section, and the cuts in the two outer pieces of the section must be such that they do not weaken the center piece. This requires holding the saw in an awkward position and is time consuming. Furthermore, at the slip joint the individual pieces of the two sections abut at their ends, and under substantial loading the fibers of corresponding pieces in the upper and lower sections tend to intermesh, thereby causing the pieces to split at their ends. This compressive loading is most likely to occur as the result of excessive moments created by wind forces on the building.

To rigidify conventional post frame buildings, it is not uncommon to install knee bracing between the roof trusses and the columns on which they are supported, these braces being merely wood pieces extended at an angle between the trusses and columns. The installation of this type of knee bracing is difficult because it requires workmen to nail the bracing in place while working at considerable height. Also, the connections are highly variable.

SUMMARY OF THE INVENTION

One of the principal objects of the present invention is to provide a method for easily and inexpensively constructing a post frame building. Another object is to provide a method of the type stated which does not require a workman to make difficult cuts at the top of an isolated pole. A further object is to provide a method of the type stated in which relatively short and inexpensive pieces of lumber are used to form the posts or columns. An additional object is to provide a method of the type stated in which most of the lumber used in the columns need not be treated with wood preservatives. Still another object is to provide a method of the type stated in which only a single field cut need be made to establish the elvation of the roof-supporting surface for each column, and that cut may be made at ground level and in a single piece of lumber. Yet another object is to provide a method of the type stated which will accommodate knee bracing without complicated installation work. A further object is to provide a post frame construction formed in accordance with the method of the type stated. An additional object is to provide a post frame construction of the type stated in which the successive pieces of lumber in the columns do not work into each other under heavy compressive loads. Another object is to provide a post frame construction of the type stated, the columns of which easily accommodate girts and facilitate the installation of them. These and other objects and advantages will become apparent hereinafter.

DESCRIPTION OF THE DRAWINGS

In the accompanying drawings which form part of the specification and wherein like numerals and letters refer to like parts wherever they occur.

DETAILED DESCRIPTION

Figures 1, 2, 3, 4, 5:
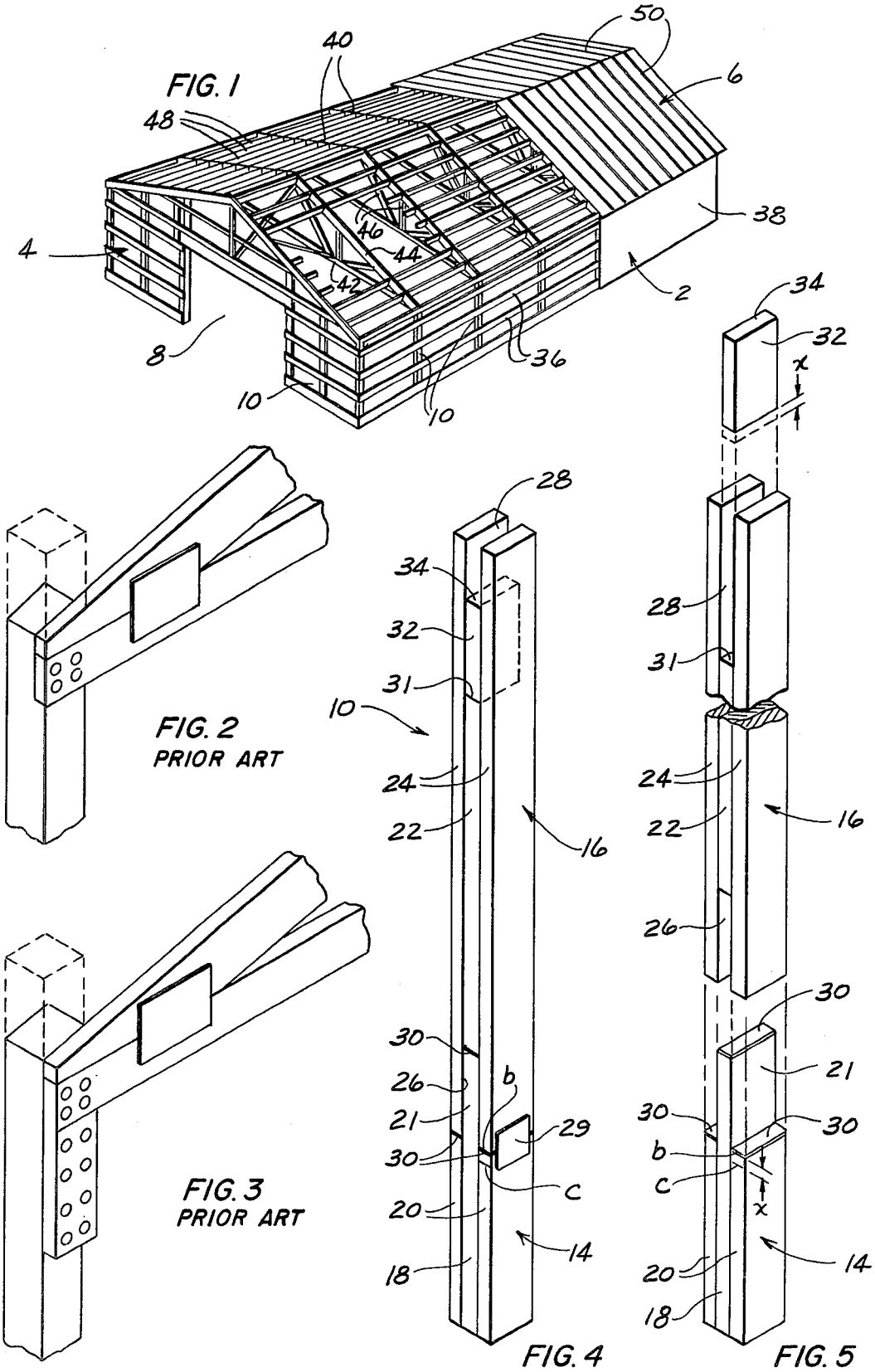
FIG. 2 PRIOR ART
FIG. 3 PRIOR ART
FIG. 1 is a perspective view of a post frame building constructed in accordance with embodying the present invention, the roofing and siding of the building being broken away and some of the purlins likewise being broken away to reveal the structural components of the building.
FIG. 2 is a fragmentary perspective view of a roof truss seated on a column in accordance with a conventional procedure.
FIG. 3 is a sectional view of a roof truss seated on a column in accordance with another conventional procedure.
FIG. 4 is a perspective view of a column forming part of the invention.
FIG. 5 is an exploded perspective view of the same column.

Referring now to the drawings, the process of the present invention may be used to construct a post frame building A (FIG. 1) having side walls 2, end walls 4, and a gable roof 6. At least one of the end walls 4 has an entry 8 in it, and similar entries may be in the side walls 2 as well. The ceiling clearance within the interior of the building to a large measure depends on the purpose for which the building is intended, and where the building is for warehouse purposes or for storing agricultrual machinery, the clearance should be about 18 to 20 feet.

Being of the post frame construction, the building A has within its side walls 2 and end walls 4, a series of vertical columns 10 that are set into holes 11 (FIG. 6) bored into the ground. The holes 11 extend downwardly about four feet, and each hole at its bottom is provided with a precast concrete pad or dry mix base 12 on which the column 10 for that hole 11 is supported. Each hole 11 is backfilled over the base 12 and around the portion of the column 10 that is below grade. Each column 10 has a lower section 14 which is set into the ground and projects a few feet above grade and an upper section 16 which is attached to the lower section 14 and extends upwardly to the roof 6. Indeed, the columns 10 support the roof 6.

Figure 6:
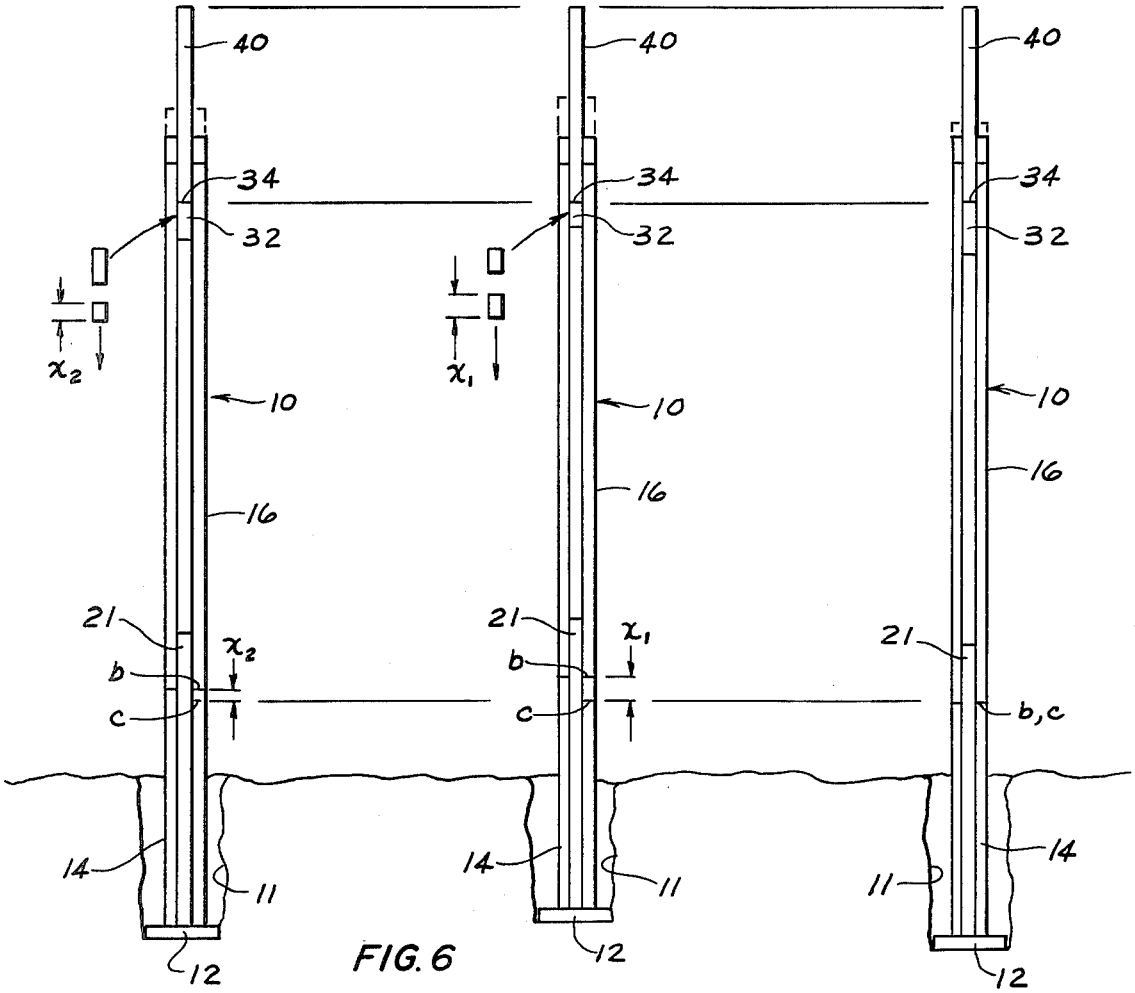
FIG. 6 is an elevational view of several columns, each being set at a different elevation but having leveling blocks that compensate for the differeneces in elevation so that all of the roof trusses supported on the columns will be at the same elevation.

The lower section 14 of each column 10 consists of (FIGS. 4 and 5) three pieces of 2×6 or 2×8 lumber—namely a center piece 18 and two side pieces 20 which are nailed or glued to the center piece 18 to create a laminated structure. All three pieces 18 and 20 are pressure treated with a wood preservative and are joined together such that their lower ends are flush. These ends of the three pieces 18 and 20 rest on the base 12 that is buried within the hole 11. The upper ends of the two side pieces 20 are likewise at the same elevation, but the center piece 18 projects beyond the upper ends of the two side pieces 20, thereby forming a tongue 21 at the upper end of the lower sections 14. The lower sections 14 of all of the columns 10 are the same length, or at least the tongues 21 of the center pices 18 for the lower sections 14 are the same length, and along one surface each lower section 14 has a reference mark b which is above grade. The reference marks b for all lower sections 14 are furthermore at the same locations on those sections, that is at the same distance from the upper ends of the tongues 21 and side pieces 20 for the lower sections 14 (FIG. 6).

The lower section 14 of each column 10 is set into its hole 11 within the ground, and the hole 11 is backfilled before the upper section 16 is secured to that lower section 14. The upper section 16 likewise includes (FIGS. 4 and 5) three pieces of 2×6 or 2×8 lumber, that is a center piece 22 and two side pieces 24, all of which are nailed or glued firmly together. Unlike the lower section 14, the center and side pieces 22 and 24 of the upper section 16 are not treated with a preservative. Moreover, neither the center piece 22 nor the two side pieces 24 need be a single piece of lumber, but instead may be several short pieces of lumber set end-to-end and preferably connected together with metal truss plates. Where shorter pieces are used, the joints in one of the pieces 22 or 24 should be offset from the joints in any of the other pieces 22 or 24. In any event, the two side pieces 24 of the upper section 16 are of the same length and have their respective upper and lower ends at the same elevation. The center piece 22, on the other hand, is somewhat shorter than the two side pieces 24 and is positioned between the two side pieces 24 such that a pocket 26 exists at the lower end of the upper section 16 and another pocket 28 exists at the upper end of the upper section 16. The length of the lower pocket 26 equals the length of the tongue 21 for the lower section 14, so that when the upper section 16 is fitted over the lower section 14 (FIG. 4), the tongue 21 on the lower section 14 will completely fill the pocket 26 at the lower end of the upper section 16. In effect, a slip joint is formed between the upper and lower sections 14 and 16, and at this joint the side pieces 24 of the upper section 16 lie to the side of the tongue 21 center piece 18 for the lower section 14. Here nails are driven through the side pieces 24 of the upper section 16 and into the tongue 21 of the lower section 14 to secure the slip joint. In addition, the joint may be reinforced by truss plates 29 which are forced into the aligned side pieces 20 and 24 of the two sections 14 and 16 so as to bridge the abutment between those aligned pieces.

Also at each slip joint it is desirable to place end plates 30 (FIGS. 4 and 5) over the upper ends of the center and side pieces 18 and 20 of the lower section 14 before the upper section 16 is installed. The plates 30 prevent the wood fibers at the end of the aligned center pieces 18 and 22 and at the aligned side pieces 20 and 24 from intermeshing under heavy compressive forces developed at the joint. These forces are more likely to be caused by moments induced by heavy wind loads than by mere weight of the roof 6, even when the roof 6 carries a substantial snow load.

Thus, when each column 10 is completed, its upper section 16 forms a continuation of its lower section 14. Each column 10 moreover has an upwardly opening slot at its upper end, that slot being the pocket 28 in the end of the upper section 16. The upper end of the center piece 22 constitutes the bottom of that pocket 28, and as such forms a bearing surface 31 (FIGS. 4 and 5). The pocket 28 at the top of each column 10 contains a leveling block 32 which rests on the center piece 22 of the upper section 16 and is secured by nails driven through the two side pieces 24. The upper surface of each block 32 likewise constitutes a bearing surface 34 and the length of each leveling block 32 is dependent on the depth to which its column 10 is set into the ground. That length is such that the upper or bearing surface 34 of the block 32 is at the same elevation as the bearing surfaces 34 on the leveling blocks 32 of the remaining columns 10 (FIG. 6). In short, the blocks 32 compensate for differences in the elevations of the bearing surfaces 31 on the upper columns sections 16, for the bearing surfaces 34 on all of the columns 10 are at the same elevation.

In addition to the columns 10, the side walls 2 and end walls 4 include girts 36 (FIG. 1) which extend horizontally between adjacent columns 10 and a sheet-like siding material 38 which is nailed to the girts 36.

The roof 6 includes roof trusses 40 (FIG. 1) which span the space between the two side walls 2 and are at their ends supported on the columns 10 of the side walls 2. In this connection, the columns 10 for the side walls 2 are arranged in pairs, there being a column 10 in the one side wall 2 that aligns with a column 10 in the other side wall 2 in the sense that the two columns 10 are equidistant from the end walls 4. Each truss 40 fits into the pockets 38 at the upper ends of the two columns 10 that support the truss 40 (FIG. 6), and the lower chord 42 of the truss 40 rests on the bearing surfaces 34 of the two leveling blocks 32 for those columns. The lower chords 42 of the two endmost trusses 40 further extend through the pockets 28 in the upper ends of the columns 10 for the end walls 4 and likewise rest on the bearing surfaces 34 of the blocks 32 in those pockets 28. Thus, all trusses 40 are supported at the same elevation and are otherwise in alignment.

Aside from the roof trusses 40, the roof 6 also includes purlins 48 (FIG. 1) which extend horizontally between the upper chords 44 of adjacent trusses 40 and light guage metal roofing 50 which extends over and is nailed to the purlins 48 and the upper chords 44 for the trusses 40 as well.

To erect the building A, the perimeter of the building A is marked off, and then a series of 12 inch diameter holes 11 are bored along the perimeter to a depth of about four feet. Normally, the spacing between adjacent holes 11 ranges between four and ten feet, but care must be exercised to insure that corresponding holes 11 for the two side walls 4 are spaced equidistantly from the end walls 4.

Next, a base 12 is either set into each hole 11 or is otherwise formed at the bottom of the hole 11, and then the lower section 14 of a column 10 is inserted into the hole 11 and lowered against the base 12. In this regard, the columns 10 are supplied with their upper and lower sections 14 and 16 detached. Moreover, the lower sections 14 of the several columns 10 are identical in length and likewise so are the upper sections 16. The lower section 14 for each side wall 2 and each end wall 4 is positioned so that it not only aligns with the mark-out of the particular wall in which it will lie, but further so it is truly vertical and has the tongue 21 at its upper end oriented transversely, that is parallel to the two end walls 4. Once the lower section 14 of each column 10 is properly positioned within its hole 11, the hole 11 is backfilled, and the fill is tampered to rigidify the lower section 14.

While an attempt is made to bore all holes 11 to the same depth, this is practically impossible given the size of the boring equipment and variations in the grade. As a consequence, the tops of the lower sections 14 will be at slightly different elevations (FIG. 6) and a difference of several inches may separate the tops of the highest and lowest lower sections 14. Of course, the same variations in elevation will exist between the reference marks b on the lower column sections 14. By using a transit, the lowest or deepest lower section 14 is determined. Next, a chalk line is placed precisely along the reference mark b of the deepest lower section 14 and extended along the remaining lower sections 14 of the row in which it is located. The chalk line is then leveled and snapped across the remaining lower section 14 so that the precise elevation of the reference mark b on the deepest lower section 14 appears as a chalk mark c (FIG. 6) on all of the lower sections 14 in the row. This elevation is transposed to the lower sections 14 of the ramining rows, again as chalk marks c. Thus, the difference in elevation between the deepest lower section 14 and any other lower section 14 in any of the rows, is the distance x between the chalk mark c and the reference mark b on that section 14.

The leveling blocks 32 for all of the columns 10 are initially the same length, and that length is somewhat less than the length of the upper pockets 28 in the upper sections 16.

Before the upper sections 16 of the columns 10 are fitted to the lower sections 14, the distance x between the chalk mark c and reference mark b on each lower section 14 is measured. A segment equalling this length x is then cut from the leveling block 32 for the column 10 (FIGS. 1 and 6). Thereupon, while the upper section 16 for the column 10 rests upon the ground, the shortened leveling block 32 is fitted into the pocket 28 of the upper section 16 for the column 10 and seated against the bearing surface 31 at the lower end of the pocket 28 so as to assume the lowest possible position in the upper section 16. The block 32 is then firmly secured in the pocket 28 by driving nails through the side pieces 24 and into the leveling block 32.

After the leveling block 32 for a column 10 has been fitted and secured to the upper section 16 for that column 10, the upper section 16 is placed on the lower section 14 for the column 10 and the two sections 14 and 16 are joined together to complete the particular column 10. In particular, the upper section 16 is lifted upwardly into a vertical disposition above the lower section 14 and is further turned so that the pocket 26 of the upper section 16 aligns with the tongue 21 that projects from the lower section 14. The upper section 16 is then lowered onto the lower section 14 until the tongue 21 is fully received in the pocket 26. To effect a good joint metal end plates 30 (FIGS. 4 and 5) should be placed over the upper ends of the center and side pieces 22 and 24 for the lower section 14 before the upper section 16 is lowered. This prevents the ends of center and side pieces 22 and 24 for the upper section 16 from abutting directly against the ends of the center and side pieces 18 and 20 for the lower section 14, which in turn prevents the wood fibers of the pieces 18, 20, 22 and 24 in the two sections 14 and 16 from intermeshing under heavy compression loads. In any event, once the upper and lower sections 14 and 16 are fitted together and properly aligned, the two sections 14 and 16 are secured firmly together by driving nails through the side pieces 24 of the upper section 16 and into the tongue 21 of the lower section 14. The slip joint which is so formed may be further strengthened by placing metal truss plates 29

(FIG. 4) across the abutting ends of the side pieces 20 and 24 for the two sections 14 and 16 and driving those plates into the side pieces 20 and 24.

When all of the columns 10 are completed in the foregoing manner, the bearing surfaces 34 on the leveling blocks 32 at the tops of the columns 10 will be at the same elevation (FIG. 6), that elevation having been established by the uncut leveling block at the top of the column 10 which is set deepest in the earth. In this regard, it will be recalled that the chalk mark c on each column 10 is taken from the reference mark b on the deepest column 10 and indeed represents the elevation of that particular reference mark b. All columns 10 are identical, at least insofar as their upper sections 15 and the mating portions of the lower sections 14 are concerned. The leveling blocks 32 are likewise identical, at least initially. The amount of wood cut from each leveling block 32 represents the distance x between the reference mark b and the chalk mark c on the column 10 for that leveling block 32, and that distance in turn is the difference in elevation between the lower bearing surface 31 for the particular column 10 and the bearing surface 31 for the most deeply set column 10. Thus, when the shortened leveling block 32 is in place in the particular column 10, its upper or bearing surface 34 will be at the same elevation as the bearing surface 34 on the uncut leveling block 32 of the deepest column 10. In other words, the shortened leveling block 32 compensates for the difference in elevation between the particular column 10 under consideration and the most deeply set column 10, and lowers the bearing surface 31 for that column 10 under consideration to the elevation for that of the most deeply set column 10.

It is significant to note that the bearing surfaces 34 for all of the columns 10 are positioned at the correct elevation through carpentry that is performed entirely at ground level. The carpenter is not required to climb a ladder or otherwise scale above grade elevation.

Once the columns 10 are erected, the roof trusses 40 are set upon them and secured in place. In particular, each roof truss 40 is hoisted upwardly above the tops of the columns 10. With its ends aligned with the upwardly opening pockets 28 in the two columns 10 on which it is to be supported, the truss 40 is lowered into the pockets 28 until its lower chord 42 comes to rest on the bearing surface 34 for the leveling blocks 32 that are within those pockets 28. When the truss 40 is properly positioned, nails are driven through the side members 24 for the upper sections 16 of the two columns 10 and into the upper chords 44 and lower chords 42 of the trusses 40, thereby securing the trusses 40 to the columns 10.

Thereafter the girts 36 (FIG. 1) are nailed to the columns 10 and the purlins 48 are nailed to the upper chords 44 of the roof trusses 40. This rigidifies the structure and provides a framework which is easy to climb. Indeed, a carpenter climbs the framework to the upper ends of the columns 10 where he cuts off those portions of the side pieces 24 that project above the upper chords 44 of the roof trusses 40 so that the upper ends of the columns 10 are flush with upper surfaces of the trusses 40. The girts 36 and purlins 48 provide convenient surfaces on which to support oneself when making such cuts.

Finally, the siding 38 (FIG. 1) is applied to the girts 36 and the roofing 50 to the purlins 48 and upper chords 44.

MODIFICATIONS

Figure 7:
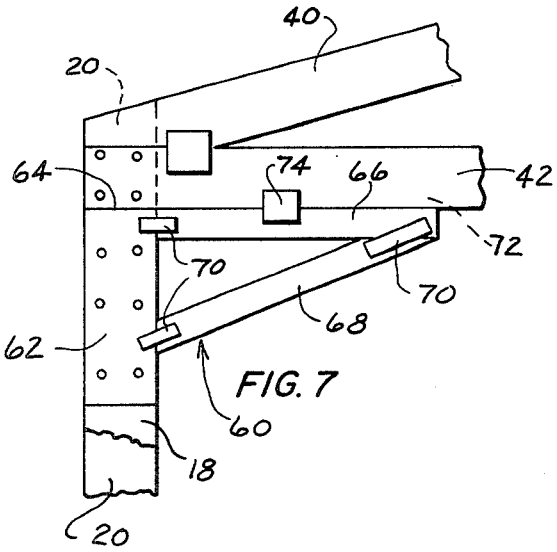
FIG. 7 is, an elevational view partially broken away and in section of a modified leveling arrangement.

To further rigidify the building A and increase the strength of its roof 6, modified leveling means 60 (FIG. 7) having knee bracing incorporated into it may be used in lieu of the leveling block 32. In this regard, knee bracing is not uncommon in post frame buildings. Usually, a knee brace consists of nothing more than a simple 2×4 piece of lumber extended at an angle between each of side wall column 10 and the lower chord 42 of the roof truss 40 that is supported on that column 10. The modified leveling means 60 is quite similar to the block 32 in that it includes a leveling block 62 that has a bearing surface 64 at its upper end and is cut off at its lower end to compensate for variances in height between the column 10 on which the block 62 is installed and the most deeply set column 10. In addition, the modified leveling block 62 has a horizontal member 66 that extends laterally from the block 62 and is flush with the bearing surface 64 on that block. Finally, the modified block 62 has a knee brace 68 that is extended between the underside of the horizontal member 66 and the inside surface of the block 62. The block 62, the horizontal member 66, and the knee brace 68 are all joined together with truss plates 70. When the modified leveling means 60 is employed, the horizontal member 66 underlies the outer portions of the lower chord 42 on the roof truss 40. Indeed, the horizontal member 66 is actually fastened to the lower chord 42 by nails 72 which are driven through the member and into the chord 42. Further rigidity may be obtained by driving truss plates 74 into the sides of the lower chord 42 and horizontal member 66.

Figure 8:
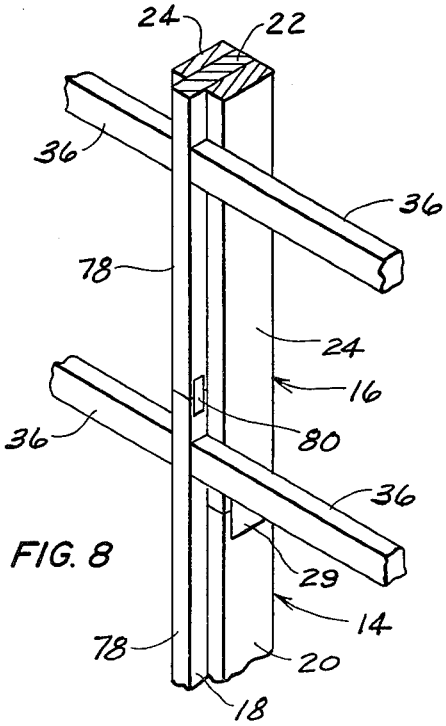
FIG. 8 is a fragmentary view of a modified column.

The columns 10 along the side walls 2 may be modified by extending the center pieces 18 and 22 of its upper and lower sections 14 and 16 for each such column 10 laterally beyond the outside edges of the side pieces 20 and 24 for those sections 14 and 16 so as to provide an outwardly directed rib 78 (FIG. 8) on the column 10. The two sections 14 and 16 of the column 10 may be secured by truss plates 80 applied to the side surfaces of the ribs 78.

When the column 10 is modified with a rib 78, the girts 36 are nailed only to the outside faces of side pieces 20 and 24 for the column 10, and the girts 36 should be about as thick as the depth of the rib 78. Thus, the outside faces of the girts 36 will be flush with the outside faces of the center pieces 18 and 20 for the column 10.

This invention is intended to cover all changes and modifications of the example of the invention herein chosen for purposes of the disclosure which do not constitute departures from the spirit and scope of the invention.

What is claimed is:

1. A method of constructing a post frame building, said method comprising: setting a series of lower column sections into the ground in an upright position, each lower section being configured to mate at its upper end with an upper column section to form a column, each upper column section having a bearing surface at its upper end and the distance between the bearing surfaces and the lower ends of all of the upper column sections being equal, each lower section having a first reference thereon and the distance between the first references and the upper ends of all of the lower sections being equal; after the lower sections are set into the ground, marking a second reference on all of the lower sections, with the second references for all of the lower sections being at the same elevation; installing a leveling block against the bearing surface at the upper end of each upper section, the length of the block being determined by the distance between the two reference marks on the lower section to which the upper section is to be joined and being such that when the upper and lower sections are joined, the upper surface of the leveling block will be at the same elevation as the upper surfaces of the leveling blocks for other columns, whereby the leveling blocks compensate for variances in elevation of the lower column sections; joining the upper column sections to their respective lower column sections to form columns; and installing the roof structure on the columns such that it is supported on the upper surfaces of the leveling blocks.

2. A method according to claim 1 wherein the leveling blocks are installed on their respective upper column sections before the upper column sections are joined to their respective lower column sections.

3. A method according to claim 2 wherein the leveling blocks for all of the columns are initially the same length and the step of installing each block against the bearing surfaces for its upper column section includes cutting a segment off of the block, with the length of that segment being correlated to the distance between the two references on the lower section of the column.

4. A method according to claim 2 and further comprising determining the lower section that is at the lowest elevation, and as to the lower section of each remaining column, cutting a portion off of the leveling block of that column, with the length of the portion removed being equal to the amount that the distance between the two references of that column exceeds the distance between the two references on the column having the lower section of least elevation.

5. A method according to claim 4 wherein the two references on the lower section of least elevation coincide, whereby the segment cut from the leveling block of each remaining column equals distance between the two reference marks on the lower section for that column.

6. A method according to claim 1 wherein the upper and lower sections of each column are laminated structures, each comprising at least three pieces of lumber joined together; and wherein the upper end of at least one of the pieces on the sections is offset from the upper ends of the remaining pieces to create a tongue and the corresponding piece in the other section is offset from the other pieces of that other section to create a pocket capable of receiving the tongue on said one section.

7. A method according to claim 1 wherein the upper section for each column is a laminated structure comprising at least three pieces of lumber joined together and the interior piece in the laminated structure is shorter than the pieces to the side of it, so that its end is offset downwardly from the ends of the piece to the side of it, whereby an upwardly opening pocket is created in the upper end of the upper section, the bearing surface of the upper section being the offset end of the interior piece; and wherein the step of installing the leveling block includes fitting it into the pocket at the upper end of the upper section.

8. A method according to claim 7 and further comprising cutting off the side pieces of the upper section substantially flush with the upper surface of the roof structure after the roof structure is installed on the columns.

9. A method according to claim 1 wherein the leveling block has a knee brace projecting generally laterally from it, and further comprising securing the knee brace to the roof structure after the roof structure is installed on the columns.

10. A method according to claim 1 wherein the column sections are made from wood, the grain of which extends longitudinally in the column, and further comprising placing hard plates between the ends of the upper and lower sections of each column where those sections are joined together, whereby the fibers of the wood in the two sections will not intermesh at the joint under heavy compressive loads.

* * * * *